US010139194B2

(12) United States Patent
Mitchell

(10) Patent No.: US 10,139,194 B2
(45) Date of Patent: Nov. 27, 2018

(54) GAS VALVE WITH TRIGGERED RELEASE FEATURE

(71) Applicant: Jeffrey R. Mitchell, Tallahassee, FL (US)

(72) Inventor: Jeffrey R. Mitchell, Tallahassee, FL (US)

( * ) Notice: Subject to any disclaimer, the term of this patent is extended or adjusted under 35 U.S.C. 154(b) by 30 days.

(21) Appl. No.: 15/182,010

(22) Filed: Jun. 14, 2016

(65) Prior Publication Data

US 2017/0356716 A1 Dec. 14, 2017

(51) Int. Cl.

| | |
|---|---|
| ***F16K 31/14*** | (2006.01) |
| ***F41B 11/723*** | (2013.01) |
| ***F41B 11/89*** | (2013.01) |

(52) U.S. Cl.

CPC ..... *F41B 11/723* (2013.01); *F41B 11/89* (2013.01); *Y10T 137/7782* (2015.04); *Y10T 137/7931* (2015.04); *Y10T 137/7932* (2015.04)

(58) Field of Classification Search

CPC ..... Y10T 137/7781; Y10T 137/7782; Y10T 137/7902; Y10T 137/7931; Y10T 137/7932

See application file for complete search history.

(56) References Cited

U.S. PATENT DOCUMENTS

| | | | | | |
|---|---|---|---|---|---|
| 1,776,613 | A * | 9/1930 | Baker | E21B 21/10 | 137/541 |
| 2,784,737 | A * | 3/1957 | Allcott | B61F 15/20 | 137/540.11 |
| 4,766,927 | A * | 8/1988 | Conatser | F16K 1/42 | 137/315.13 |
| 5,172,720 | A * | 12/1992 | Richards | F16K 15/063 | 137/234.5 |
| 8,869,823 | B2 * | 10/2014 | Mooney | F16K 15/03 | 137/454.2 |

* cited by examiner

*Primary Examiner* — R. K. Arundale
(74) *Attorney, Agent, or Firm* — J. Wiley Horton

(57) ABSTRACT

A gas valve that can be opened using a trigger mechanism. When triggered, the valve is preferably configured to deliver a rapid release of air and then reset itself in the closed state. Once in the closed state, pressure may again be built on the upstream side of the valve until another release is desired.

18 Claims, 9 Drawing Sheets

GAS VALVE WITH TRIGGERED RELEASE FEATURE

CROSS-REFERENCES TO RELATED APPLICATIONS

Not Applicable.

STATEMENT REGARDING FEDERALLY SPONSORED RESEARCH OR DEVELOPMENT

Not applicable

MICROFICHE APPENDIX

Not Applicable

BACKGROUND OF THE INVENTION

1. Field of the Invention

This invention relates to the field of valves. More specifically, the present invention comprises a valve assembly configured for a rapid release of pressure when a triggering mechanism is actuated.

2. Description of the Related Art

The present invention has application wherever a pressurized gas needs to be selectively released. One non-limiting application is that of soft projectile launchers. A soft-projectile launcher is commonly used by children for target practice and for war-type games. The projectile may be a piece of compressible foam or a marshmallow.

FIGS. 1-3 depict a marshmallow shooter incorporating the present invention. These figures are not labeled as "prior art" because the marshmallow shooter includes the novel inventive valve. However, those skilled in the art will realize that the marshmallow shooter includes many prior art features. These features will be described in this "BACKGROUND" section and the novel features will then be described in later sections.

FIG. 1 illustrates a projectile launcher 12 incorporating the inventive valve. The projectile is fired through barrel 16 and out of muzzle 18. Reservoir/pump assembly 20 stores a volume of compressed air. Pump handle 24 is used to pressurize the air within the reservoir. Valve assembly 22 regulates the flow of gas to launch the projectile. Trigger 14 selectively releases the gas. Grip 12 allows the user to easily grip the projectile launcher while keeping a finger on the trigger. Carry handle 46 allows the user to easily grasp and carry the launcher.

FIGS. 2 and 3 are sectional elevation views through the launcher. They are intended to show the features of the launcher other than the inventive valve, so that the reader may understand one operational environment in which the inventive valve may be used (but by no means the only operational environment). The inventive valve itself will be described subsequently. Many of the components depicted in FIGS. 2 and 3 are also shown in simplified form for purposes of visual clarity.

In FIG. 2, reservoir 26 is designed to contain a pressurized air supply. The user builds pressure by grasping pump handle 24 and cycling piston 34 and rod 30 in pump cylinder 28. As the user pulls pump handle 24 rearward, air passes through vent 32 and through first check valve 36. This air flows into the volume to the left of piston 34 (with respect to the orientation shown in the view). Second check valve 38 remains closed during the rearward stroke. Once the pump handle reaches the rearward limit of its stroke, the user pushes it forward. At this point increasing pressure ahead of piston 34 causes first check valve 36 to close. The volume ahead of the piston is thereby pressurized.

As the forward stroke of the piston continues the increasing pressure ahead of the piston exceeds the pressure within reservoir 26 and second check valve 38 opens. The air ahead of the piston then flows through second check valve 38 into reservoir 26. This cyclic pumping action may be repeated through multiple strokes. Eventually the pressure within reservoir 26 will build to the point that pump cylinder 28 is no longer able to add additional pressure.

Valve assembly 22 controls the flow of air out of reservoir 26. In the invention, trigger 14 is pulled to open the valve assembly and release the pressure within the reservoir into firing chamber 42. A soft projectile located within firing chamber 42 (not shown in FIG. 2) is propelled by the released air into bore 40 and out muzzle 18.

FIG. 3 shows how a soft projectile is loaded into the launcher. In the embodiment shown, a release catch is actuated and barrel assembly 48 pivots downward about hinge pin 44. Breach 50 is thereby exposed. A projectile 52 is loaded into breach 50 and barrel assembly 48 is then rotated upward and latched into place (as shown in FIG. 2). The user then launches the projectile by pulling the trigger.

A launcher such as shown in FIGS. 1-3 will benefit from a trigger-actuated valve providing a controlled release of pressure. The present invention provides such a valve.

BRIEF DESCRIPTION OF THE INVENTION

The present invention comprises a gas valve that can be opened using a trigger mechanism. When triggered, the valve is preferably configured to deliver a rapid release of air and then reset itself in the closed state. Once in the closed state, pressure may again be built on the upstream side of the valve until another release is desired.

A movable valve body defines the open and closed state of the valve. The valve body moves within a surrounding housing. Pressure accumulates on the upstream side of the valve. When the valve is triggered, the valve body moves in the downstream direction and releases the pressurized gas in the downstream direction. A positive seal is created by the mating of an upstream conical surface on the valve body and a downstream conical surface on a seal held in place in the surrounding housing. The valve body is maintained in the closed state by a movable sear. A trigger mechanism moves the sear out of the way in order to open the valve.

REFERENCE NUMERALS IN THE DRAWINGS

Figure 1:
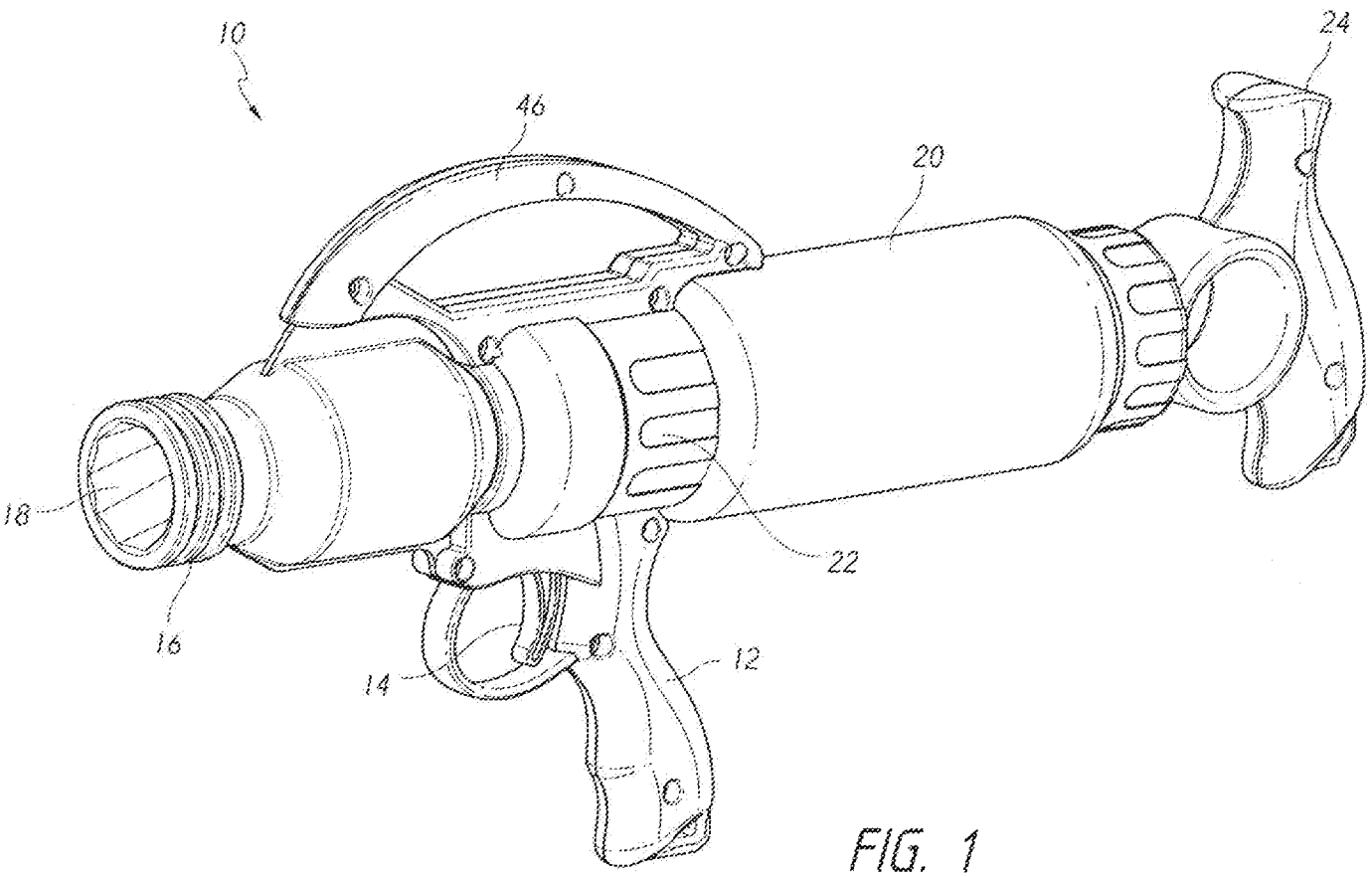
FIG. 1 is a perspective view, showing a typical application for the inventive gas valve assembly.
Figure 2:
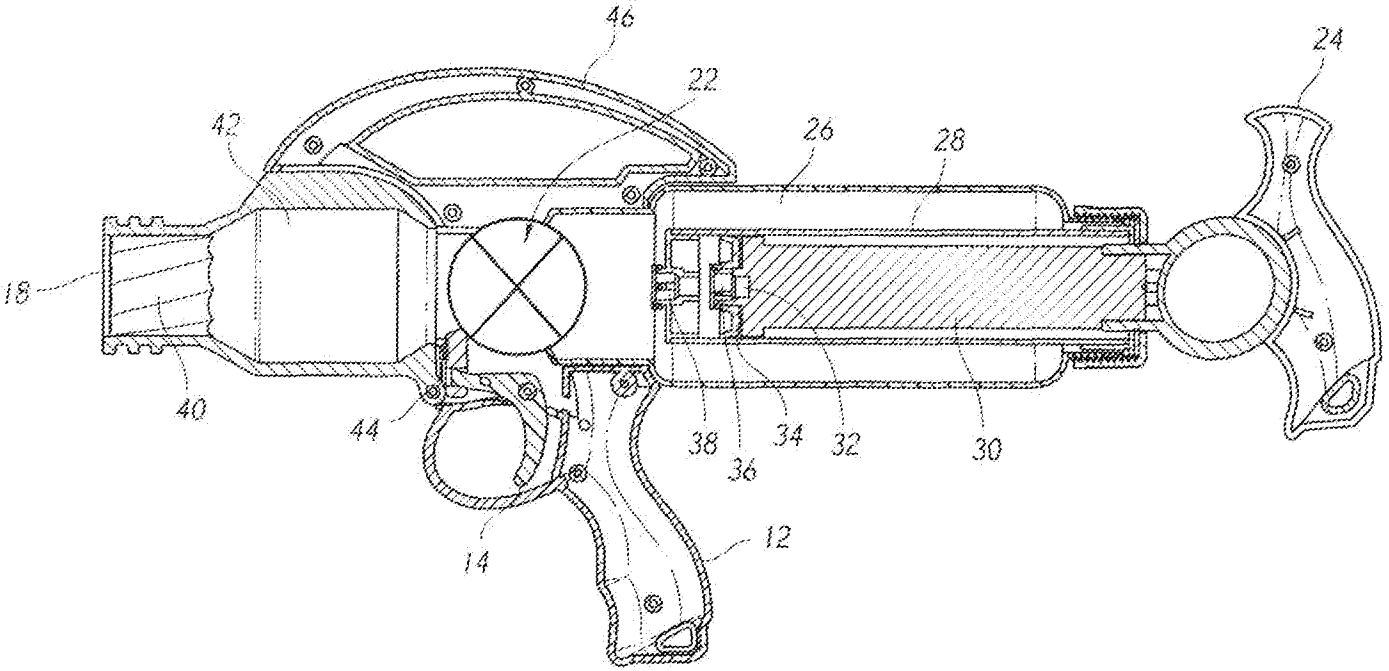
FIG. 2 is a sectional elevation view, showing how the inventive valve assembly can be used in a projectile launcher.
Figure 3:
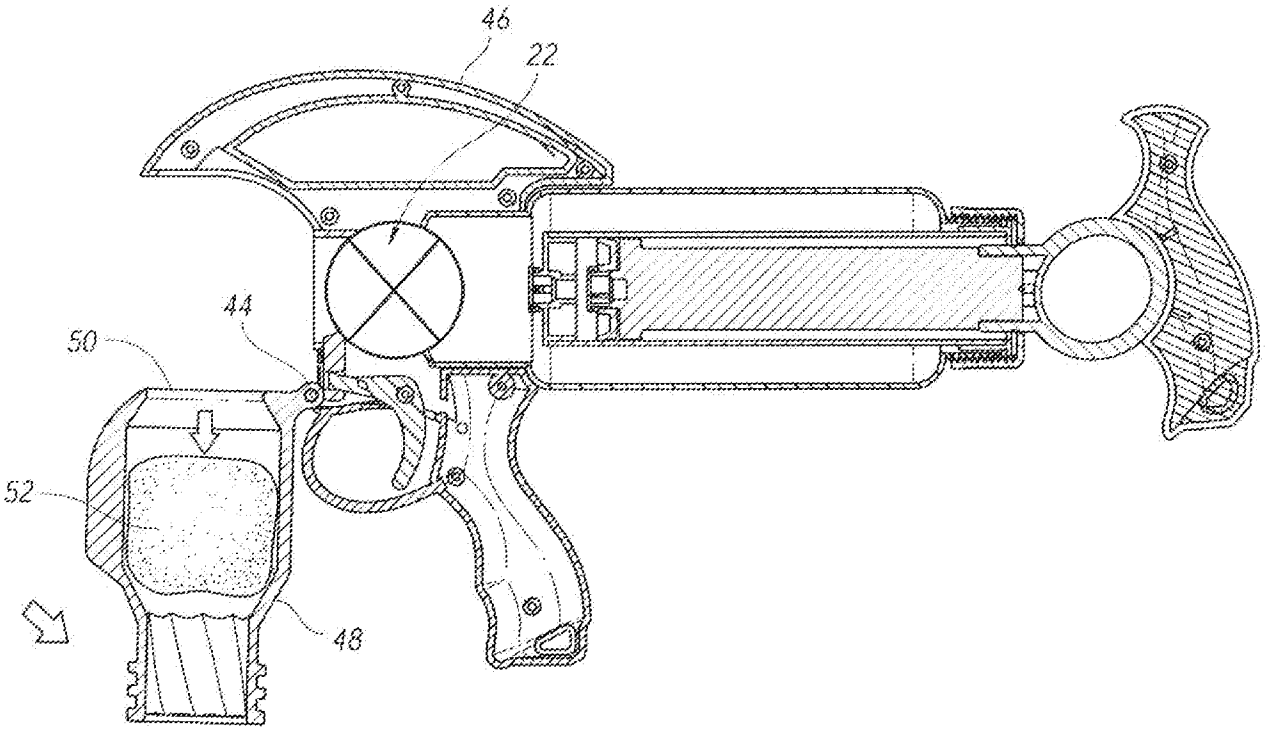
FIG. 3 is a sectional elevation view, showing how the projectile launcher of FIG. 2 is loaded.

10 projectile launcher
12 grip
14 trigger
16 barrel
18 muzzle
20 reservoir/pump assembly
22 valve assembly
24 pump handle
26 reservoir
28 pump cylinder
30 rod
32 vent
34 piston
36 first check valve
38 second check valve
40 bore
42 firing chamber
44 hinge pin
46 carry handle
48 barrel assembly
50 breach
52 projectile
54 valve body
56 disk
58 column
60 spring retainer
62 rib
64 spring retainer surface
66 stop surface
68 upstream conical surface
70 downstream housing
72 upstream housing
74 pivot
76 sear
78 passage
80 actuator tip
82 threaded engagement
84 spring
86 spring retainer
88 seal
90 flexible extension
92 central axis
94 downstream conical surface
96 retention feature
98 upper surface
100 annular groove

DETAILED DESCRIPTION OF THE INVENTION

Figure 4:
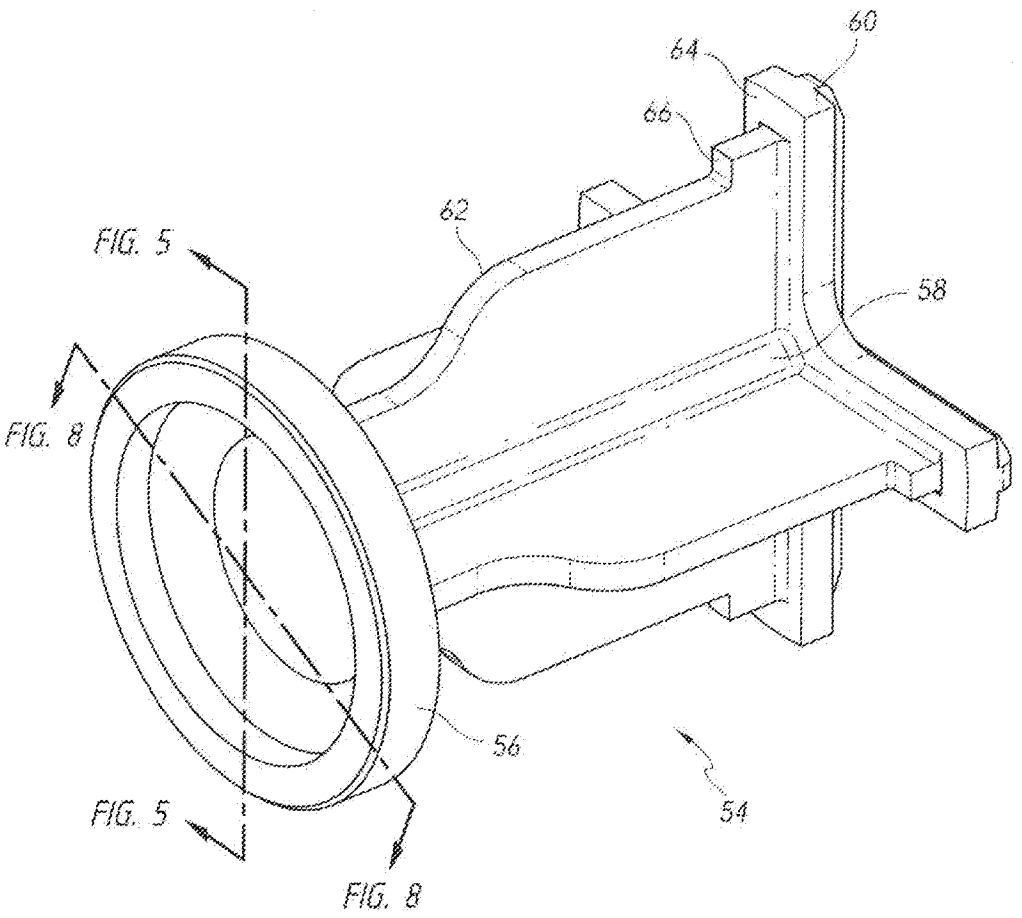
FIG. 4 is a perspective view, showing a valve body used in the inventive valve assembly.

The present invention provides a valve for controlling the flow of a compressed gas—such as air. The valve's operation depends upon the position of a movable valve body. FIG. 4 shows this component—denoted as valve body 54. The sealing functions are carried out by disk 56. An elongated column 58 connects disk 56 to a cruciform spring retainer 60. Four ribs 62 are provided for purposes of stiffening the structure and maintaining the proper location of an associated compression spring. Stop surface 66 stops the downstream motion of the valve body when the valve is opened. Spring retaining surface 64 bears against the aforementioned compression spring.

Figure 5:
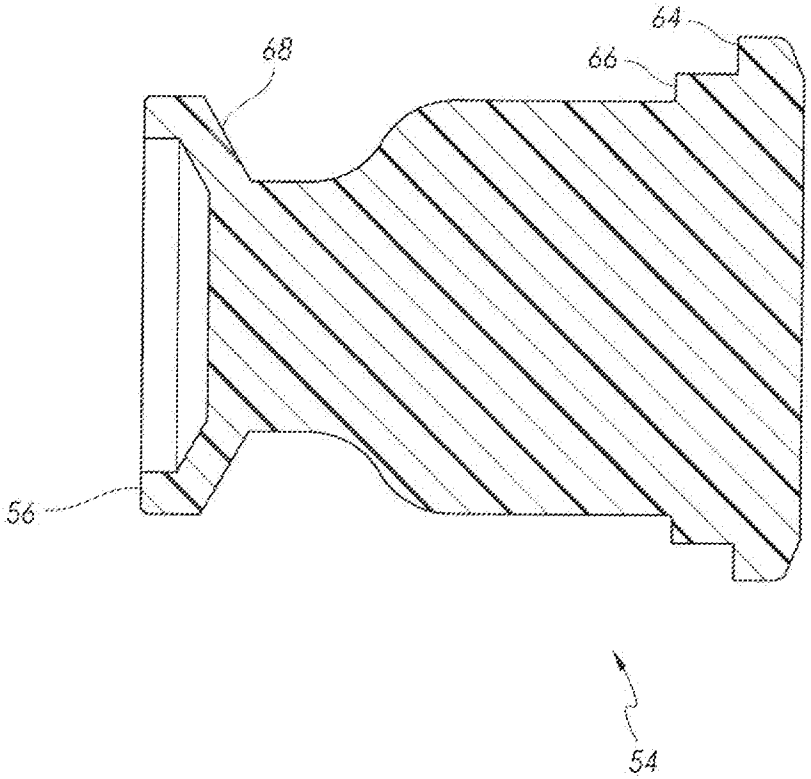
FIG. 5 is a sectional elevation view, showing the valve body of FIG. 4.

FIG. 5 shows a sectional elevation view through the valve body—taken through the plane of two of the ribs 62. The reader will observe that disk 56 includes an upstream conical surface 68 (The term "upstream" meaning that this conical surface faces in the "upstream" direction with respect to the flow of gas through the valve). The reader will also note the positions of stop surface 66 and spring retainer surface 64. The functions of these geometric features will be apparent from reviewing the completed assembly.

Figure 6:
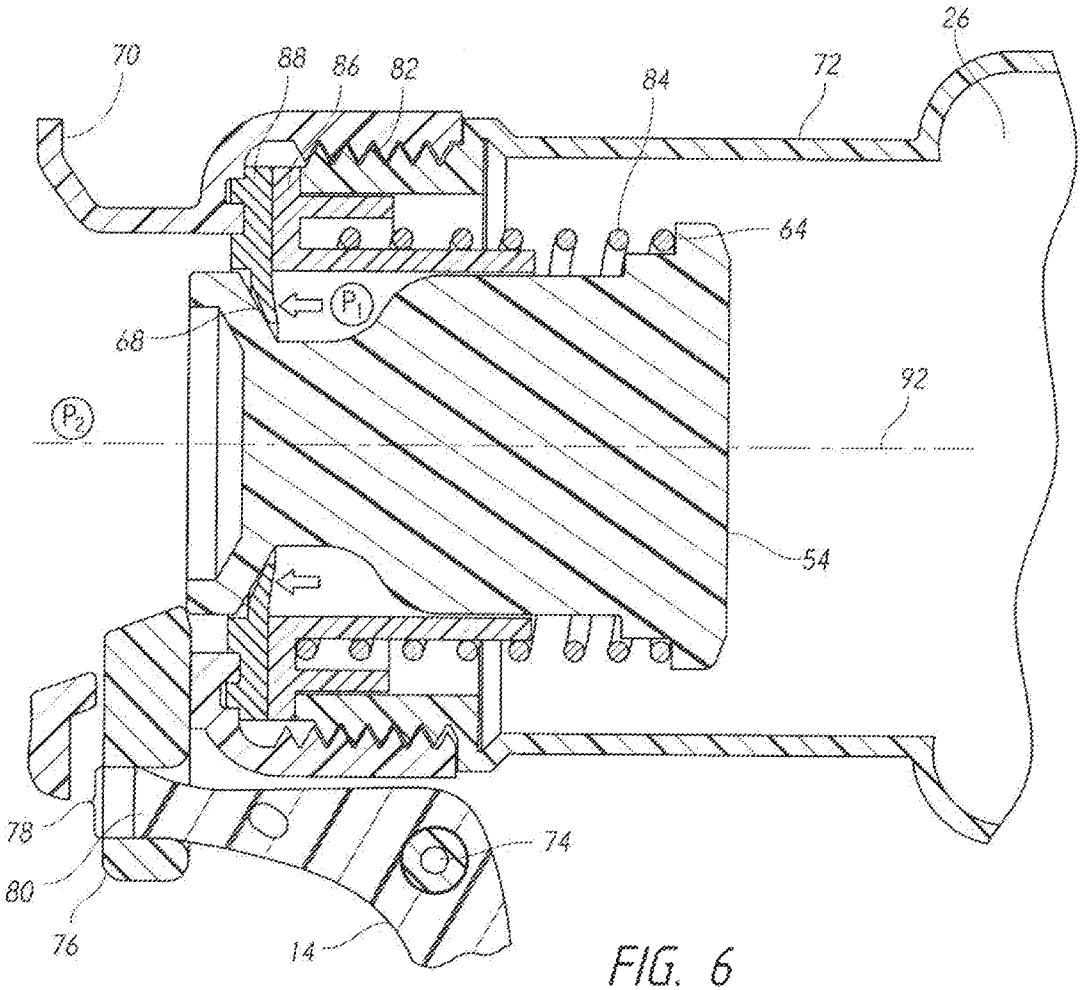
FIG. 6 is a sectional elevation view, showing the components of the inventive valve assembly in a closed state.

FIG. 6 shows a sectional elevation view through an exemplary embodiment of a complete assembly. The inventive valve mechanism is preferably contained within an appropriate housing. The housing may be part of a larger device or it may be free-standing. In the embodiment of FIG. 6 the housing is part of a larger device and is in fact split into two pieces. Upstream housing 72 serves to position components of the valve assembly and also serves as part of the reservoir 26 of a projectile launcher. Downstream housing 70 serves to position components of the valve assembly and also serves as a mount for the trigger mechanism and other portions of the projectile launcher. The two housings are united by threaded engagement 82.

The valve assembly in this embodiment is preferably radially symmetric about central axis 92. For example, seal 88 assumes the general form of an O-ring. The valve is shown in a closed state. In the embodiment shown, valve body 54 moves to the left along central axis 92 when the valve is opened (To the left in the view is the "downstream" direction and to the right is the "upstream" direction). Pressure is built within reservoir 26. This is denoted as $P_1$. The pressure downstream of the valve in the embodiment shown in simply the ambient air pressure—denoted as $P_2$. The sealing of the valve in the closed state is accomplished by a portion of seal 88 being urged against upstream conical surface 68 on valve body 54—as indicated by the arrows. As $P_1$ increases with respect to $P_2$ the force urging seal 88 again upstream conical surface 68 increases.

Seal 88 is an annular ring made of flexible material. Exemplary materials include natural rubber, synthetic rubber, and silicon. It preferably incorporates mechanical interlocking features to hold it in position. In this example, a downstream-facing protrusion on seal 88 fits into an annular cavity in an upstream-facing portion of downstream housing 70. Spring retainer 86 compresses a portion of seal 88 against downstream housing 70 to hold it in place.

Spring retainer 86 is clamped in position as threaded engagement 82 is tightened. The compressible nature of seal 88 provides a positive retaining force for the assembly similar to the function of a lock washer. The reader will note that spring retainer 86 includes features configured to positively locate compression spring 84. Spring 84 bears against spring retainer surface 64 on valve body 54. The spring thereby holds valve body 54 in the closed position shown.

Of course, as pressure within reservoir 26 builds the closing force of spring 84 will be overcome and the valve will crack open—much like a pressure regulating valve. This action is not desired in the present invention. One goal of the present invention is the sharp release of a significant pressure differential. In order to accomplish this goal, an additional mechanism is provided to hold valve body 54 in the closed position.

Sear 76 moves substantially transversely to central axis 92 ("substantially" herein defined as meaning within 20 degrees of perpendicular to central axis 92). The sear is shown in the latched position in FIG. 6—holding the valve in the closed state. In the embodiment shown, sear 76 slides up and down within an enclosing channel in downstream housing 70 (The terms "up" and "down" are stated with respect to the orientation of the view and should not be read as limiting). Valve body 54 is forced against the sear as the pressure within reservoir 26 increases. The forces acting on the sear are transmitted to housing 70 so that the sear is retained in position.

The sear also contains a passage 78 (such as a transverse slot through the sear). Actuator tip 80 of trigger 14 rests within passage 78. Trigger 14 pivots about pivot 74, which is also secured to downstream housing 70 in this embodiment. When the user pulls the lower portion of the trigger, actuator tip 80 moves downward. This motion urges sear 76 downward until it is no longer engaged with valve body 54. This motion "fires" the valve.

Figure 7:
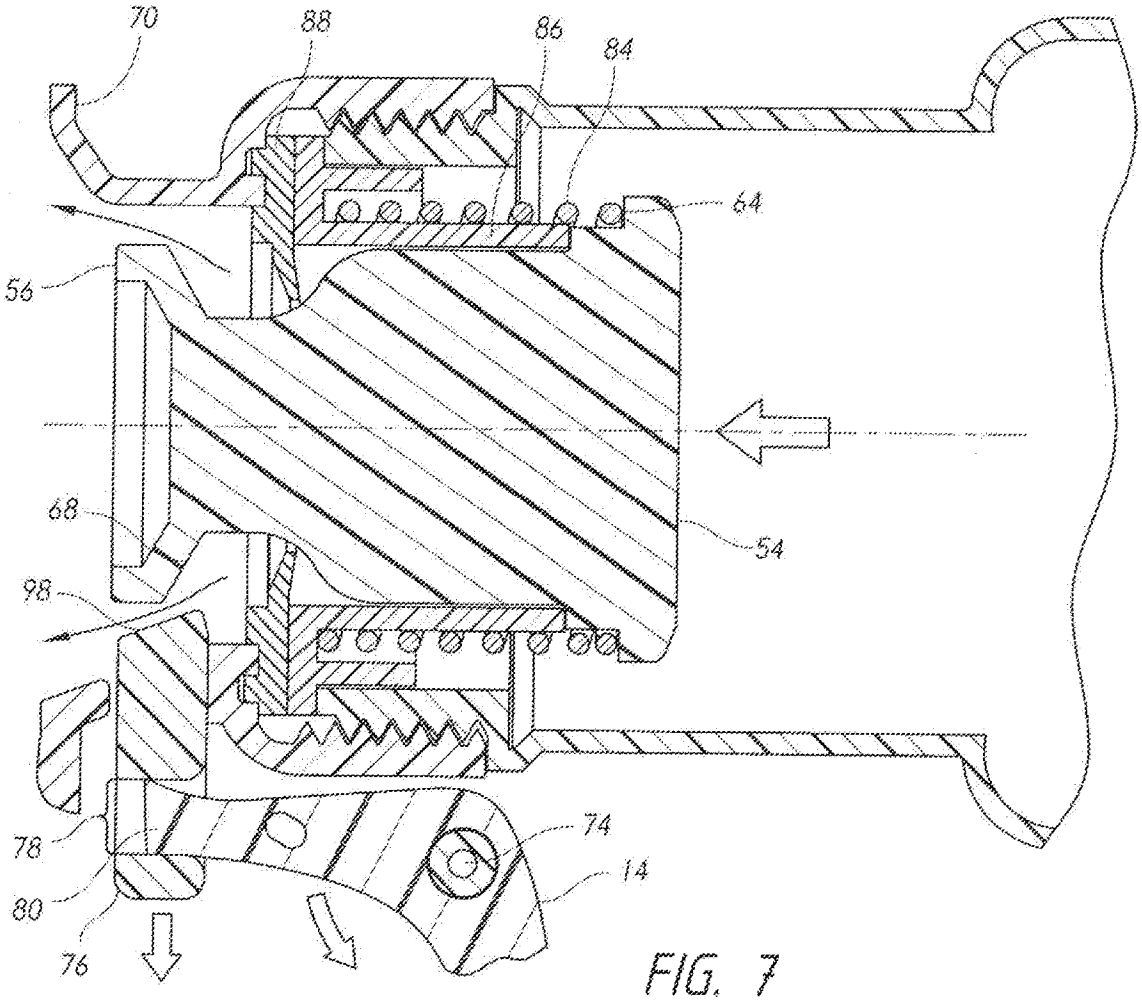
FIG. 7 is a sectional elevation view, showing the components of the inventive valve assembly in an open state.

FIG. 7 shows the "firing cycle" of the valve. At the point shown sear 76 has been pulled out of engagement with valve body 54. The pressure differential across the valve body then forces it downstream (to the left in the view). Upstream conical surface 68 on disk 56 moves out of engagement with seal 88 and allows air to flow through the valve as indicated by the curving arrows. Spring 84 is compressed by spring retention surface 64 on valve body 54. Depending on the rate of flow, the compression of spring 84 may be enough to arrest the further downstream movement of valve body 54. If spring compression alone is insufficient, the reader will note that stop surface 66 (on the valve body) will eventually come to rest against the upstream extreme of spring retainer 86 and limit any further downstream movement of the valve body. The reader will also note how the structure of spring retainer 86 keeps the spring in alignment and prevents any buckling deformation of the spring.

Figure 8:
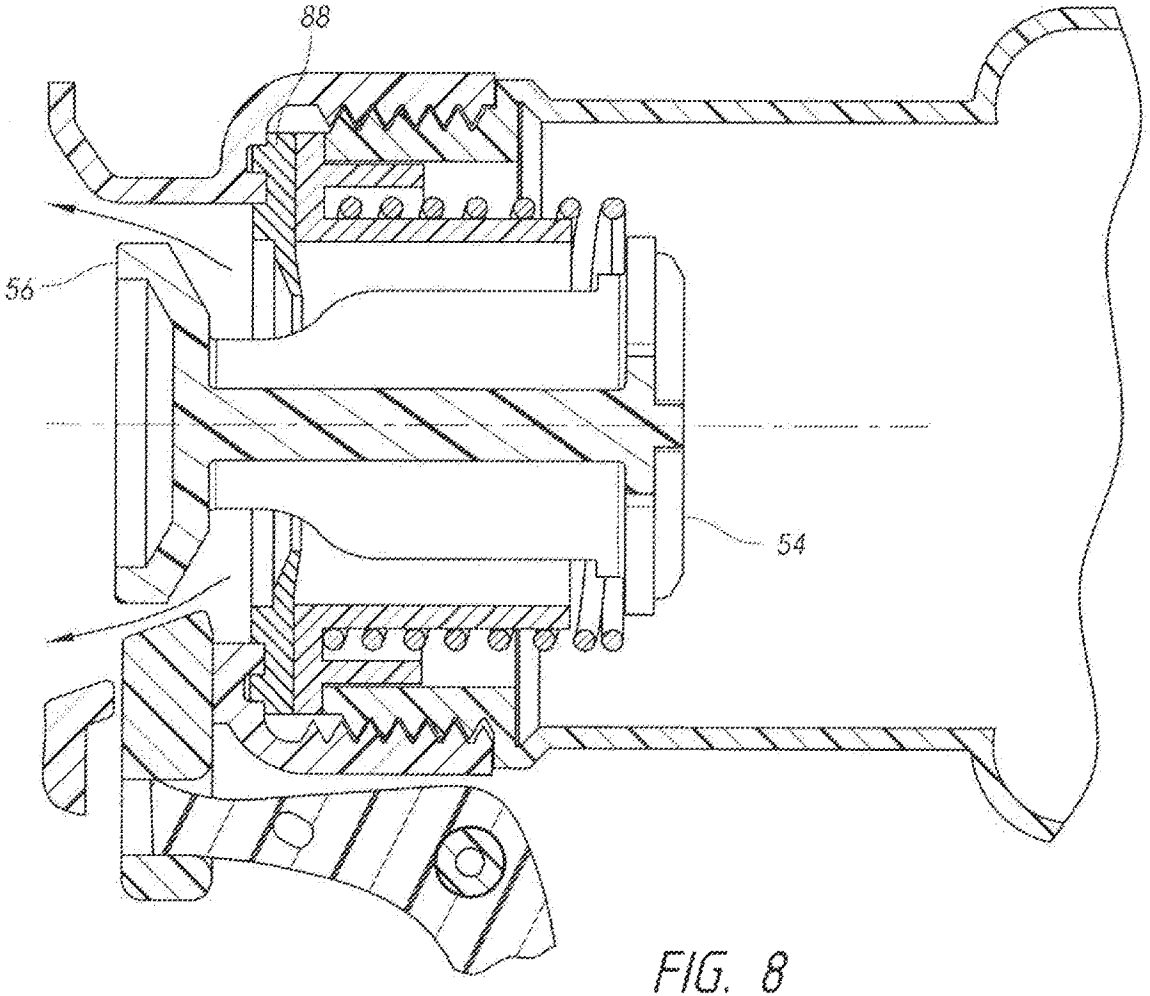
FIG. 8 is a sectional elevation view, showing the components of the inventive valve assembly in an open state.

The section plane in the view of FIG. 7 passes through two of the ribs on valve body 54 and this produces a somewhat deceptive depiction. In FIG. 7 it appears that relatively little free passage room is available for the gas escaping through the opened valve. This is actually not the case. Returning to FIG. 4, the reader will note that the section "call out" for FIG. 8 selects a section view plane that does not pass through ribs 62. Looking now at FIG. 8, the reader will observe that significant clearance exists for the gas passing through the open valve. Column 58 of valve body 54 occupies relatively little volume. In this example the valve body is free to rotate so the section plane chosen for the valve body is somewhat arbitrary.

Returning to FIG. 7, the completion of a "firing cycle" will be explained. Once the compressed gas within the reservoir is vented through the valve, spring 84 tends to urge valve body 54 back upstream. Upper surface 98 of sear 76 is preferably given an angled shape as shown. Upstream conical surface 68 of valve body 54 bears against angled surface 98 (as the valve body moves toward the closed position) and urges sear 76 downward (if necessary) so that valve body 54 can return to its upstream (closed) position. Sear 76 may be provided with a return spring tending to urge it upward (All directional terms such as "upward" should be understood as referring only to the orientation shown in the particular view and should not be read as limiting). Once upstream conical surface 68 passes over upper surface 98, sear 76 pops upward (assuming the sear is equipped with a return spring). The configuration of FIG. 6 is thereby restored. The valve in this state is ready to remain in the closed position until the trigger is pulled again.

Figure 9:
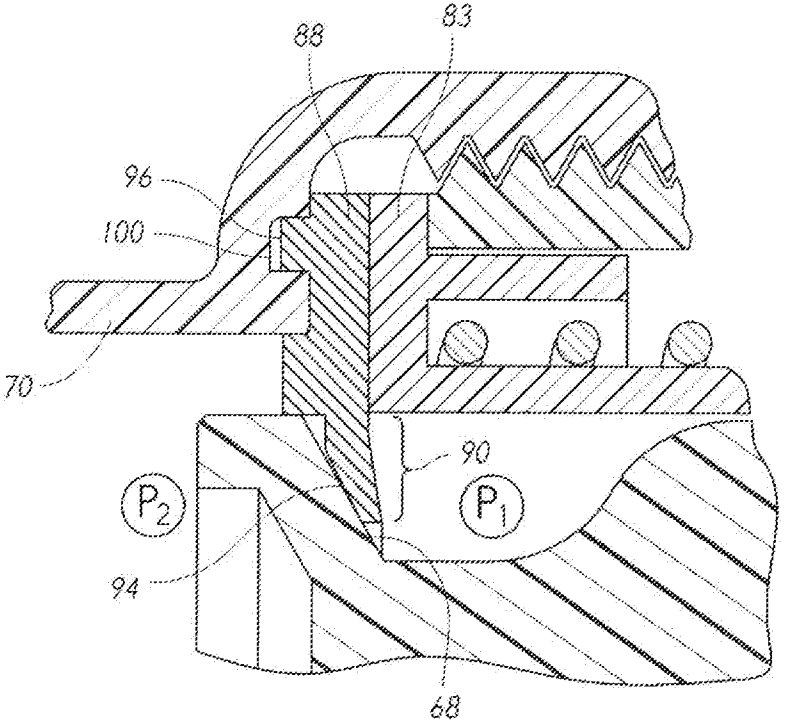
FIG. 9 is a sectional elevation view, showing a detail of how the valve is sealed.

The inventive valve assembly preferably includes some features intended to ensure a positive seal. FIG. 9 is a detailed view showing the upper portion of FIG. 6 in greater detail. Seal 88 preferably includes one or more retention features 96 (in this case a protruding portion). Downstream housing 70 in this example includes an annular groove 100 configured to receive a retention feature 96 on seal 88. Seal 88 is thereby positively located.

Seal 88 also includes a flexible extension 90 extending inward toward the central axis of the valve assembly. This flexible extension includes downstream conical surface 94 (facing to the left in the orientation of the view). Upstream conical surface 68 is shaped to mate against downstream conical surface 94. As the pressure $P_1$ increases with respect to $P_2$ flexible extension 90 is pressed more tightly against upstream conical surface 68. The reader will note that the interface between downstream conical surface 94 and upstream conical surface 68 is quite long. In other words, in order to escape, air must travel between the two mated surfaces for a long distance rather than just past a short "pinch point." This elongated interface increases the security of the valve. It is preferable for the mating of the two surfaces to span a range of diameters that is at least one-tenth the overall diameter of disk 56 and even more preferable for the mating to span a range of diameters that is at least one-fourth the overall diameter of disk 56.

Other embodiments of the inventive valve may include many other features beyond those shown in the accompanying drawings. These include:

1. A return spring located on the trigger, the sear, or both;
2. A dashpot positioned to eliminate cyclic movement of the trigger, the sear, or both;
3. A mechanism intended to promote cyclic operation of the valve mechanism to trigger a series of multiple, controlled discharges;
4. A bearing to smooth the motion of the sear;
5. A multi-link latching sear mechanism; and
6. A sear that does not move in a direction that is transverse to the central axis of the valve mechanism.

The example provided in the drawing views uses several molded thermoplastic parts—such as the housings and the valve body. Thermoplastics are suitable for moderate pressures and non-corrosive gases. The inventive valve may be made of other materials for other applications. For example, aluminum or stainless steel could be used for applications requiring higher pressures or temperatures. The seal could even be made of metallic material for high temperature applications.

The preceding description contains significant detail regarding novel aspects of the present invention. It should not be construed, however, as limiting the scope of the invention but rather as providing illustrations of the preferred embodiments of the invention. Thus, the scope of the invention should be determined with reference to the following claims rather than any specific embodiment.

Having described my invention, I claim:

1. A valve, having an upstream side and a downstream side, for selectively releasing a pressurized gas stored on said upstream side, comprising:

a. a housing;
b. a valve body including a disk, a column, and a spring retainer;
c. wherein said disk includes an upstream conical surface;
d. a seal connected to said housing, wherein said seal includes a downstream conical surface configured to mate against said upstream conical surface on said disk;
e. a sear, configured to move between a first position in which said sear holds said valve body against said seal and a second position in which said sear releases said valve body; and f. a separate trigger configured to cause said sear to move from said first position to said second position.

2. The valve as recited in claim 1, further comprising a spring configured to urge said valve body toward said upstream side by pressing against said spring retainer.

3. The valve as recited in claim 2, wherein:

a. said valve body moves along a central axis; and b. said sear moves in a direction that is substantially perpendicular to said central axis.

4. The valve as recited in claim 1, wherein:

a. said sear includes a passage therethrough; and b. said trigger includes an actuator tip resting within said passage in said sear.

5. The valve as recited in claim 4 wherein said trigger pivots about a pivot that is distal to said sear.

6. The valve as recited in claim 1, wherein:

a. said seal includes a flexible extension; and b. said downstream conical surface is located on said flexible extension.

7. The valve as recited in claim 6, wherein said downstream conical surface on said flexible extension and said upstream conical surface on said disk overlap for a range of diameters that is at least one-tenth an overall diameter of said disk.

8. The valve as recited in claim 6, wherein said downstream conical surface on said flexible extension and said upstream conical surface on said disk overlap for a range of diameters that is at least once-forth an overall diameter of said disk.

9. The valve is recited in claim 1 wherein said homing includes on upstream housing and a downstream housing.

10. A valve, having an upstream side and a downstream side, for selectively releasing a pressurized gas stored on said upstream side, comprising:

a. a housing;

b. a valve disk;

c. wherein said valve disk includes an upstream conical surface;

d. a seal connected to said housing, wherein said seal includes a downstream conical surface configured to mate against said upstream conical surface on said valve disk;

e. a sear, configured to move between a first position in which said sear holds said valve disk against said seal and a second position in which said sear releases said valve disk; and f. a separate trigger configured to cause said sear to move from said first position to said second position.

11. The valve as recited in claim 10, further comprising:

a. wherein said disk is part of a valve body including a column and a spring retainer; and b. a spring configured to urge said valve body toward said upstream side by pressing against said spring retainer.

12. The valve as recited in claim 11, wherein:

a. said valve body moves along a central axis; and b. said sear moves in a direction that is substantially perpendicular said central axis.

13. The valve as recited in claim 10, wherein:

a. said sear includes a passage therethrough; and b. said trigger includes an actuator tip resting within said passage in said sear.

14. The valve as recited in claim 13 wherein said trigger pivots about a pivot that is distal to said sear.

15. The valve as recited in claim 10, wherein:

a. said seal includes a flexible extension; and b. said downstream conical surface is located on said flexible extension.

16. The valve as recited in claim 15, wherein said downstream conical surface on said flexible extension and said upstream conical surface on said disk overlap for a range a diameters that is at least one-tenth an overall diameter of said disk.

17. The valve as recited in claim 15, wherein said downstream conical surface on said flexible extension and said upstream conical surface on said disk overlap for a range of diameters that is at least one-fourth an overall diameter of said disk.

18. The valve as recited in claim 10 wherein said housing includes an upstream housing and a downstream housing.

* * * * *